US008287437B1

(12) United States Patent
Rovere

(10) Patent No.: US 8,287,437 B1
(45) Date of Patent: Oct. 16, 2012

(54) MARTIAL ART TRAINING PAD

(76) Inventor: Michael V. Rovere, Huntington Beach, CA (US)

( * ) Notice: Subject to any disclaimer, the term of this patent is extended or adjusted under 35 U.S.C. 154(b) by 89 days.

(21) Appl. No.: 12/820,015

(22) Filed: Jun. 21, 2010

Related U.S. Application Data

(60) Provisional application No. 61/269,248, filed on Jun. 22, 2009.

(51) Int. Cl.
*A63B 69/34* (2006.01)
*A63B 69/00* (2006.01)

(52) U.S. Cl. ..... 482/83; 482/88; 473/444

(58) Field of Classification Search ..... 482/81–89; 434/247; 473/444
See application file for complete search history.

(56) References Cited

U.S. PATENT DOCUMENTS

| | | | | | |
|---|---|---|---|---|---|
| 2,526,217 | A | * | 10/1950 | Gilman | 473/444 |
| 2,574,046 | A | | 11/1951 | Logan | |
| D168,302 | S | | 12/1952 | Holt | |
| 4,138,742 | A | * | 2/1979 | Meeks | 2/84 |
| 4,168,554 | A | * | 9/1979 | Hindes | 5/722 |
| 4,546,966 | A | * | 10/1985 | Segura | 482/88 |
| 4,604,987 | A | * | 8/1986 | Keltner | 126/204 |
| 4,667,954 | A | * | 5/1987 | McCorkle | 482/86 |
| 4,697,286 | A | * | 10/1987 | Cho | 2/22 |
| 4,789,046 | A | * | 12/1988 | McDowall | 182/230 |
| 4,883,635 | A | * | 11/1989 | Goradesky | 482/83 |
| 5,019,064 | A | * | 5/1991 | Eilender | 604/378 |
| 5,088,747 | A | * | 2/1992 | Morrison et al. | 297/219.1 |
| 5,209,691 | A | * | 5/1993 | Ekstein | 446/28 |
| 5,232,368 | A | * | 8/1993 | Morgia | 434/247 |
| 5,265,292 | A | * | 11/1993 | Underell | 5/419 |
| 5,333,921 | A | * | 8/1994 | Dinsmoor, III | 297/219.1 |
| 5,491,851 | A | * | 2/1996 | Alonso | 5/722 |
| 5,501,649 | A | | 3/1996 | Queppet | |
| 5,685,257 | A | * | 11/1997 | Feibus | 119/28.5 |
| 5,964,683 | A | | 10/1999 | Norblom | |
| 6,076,211 | A | * | 6/2000 | Chatman | 5/653 |
| 6,258,013 | B1 | * | 7/2001 | Dabney | 482/83 |
| 6,325,747 | B1 | | 12/2001 | Norblom | |
| 6,413,194 | B1 | * | 7/2002 | Gant | 482/112 |
| D489,846 | S | | 5/2004 | Singh | |
| 7,338,116 | B1 | * | 3/2008 | Lin et al. | 297/46 |
| 7,739,758 | B2 | * | 6/2010 | Weedling et al. | 5/81.1 R |
| 7,819,484 | B2 | * | 10/2010 | Conforti | 297/452.21 |
| 7,900,299 | B2 | * | 3/2011 | Weedling et al. | 5/81.1 R |
| 2005/0159279 | A1 | * | 7/2005 | Stangler | 482/148 |

(Continued)

OTHER PUBLICATIONS

"Headbanger Deluxe" shield, Macho Martial Arts website, www.macho.com.

(Continued)

*Primary Examiner* — Stephen Crow
(74) *Attorney, Agent, or Firm* — QuickPatents, Inc.; Kevin Prince

(57) ABSTRACT

A pad system for using in training for martial arts is disclosed, and includes a long chamber having a first flexible sheath that surrounds a first cushioning pad made with a relatively rigid and firm foam material to prevent penetration and deflection thereof. A short chamber includes a second flexible sheath that surrounds a second cushioning pad of a second firmness less than the firmness of the first cushioning pad. The short chamber is fixed with the long chamber, such that side edges of each chamber are substantially mutually aligned and such that top and bottom edges of the long chamber overhang top and bottom edges of the short chamber, respectively, thereby defining overlapping volumes having a pair of handles situated therein and fixed to either of the chambers.

21 Claims, 2 Drawing Sheets

U.S. PATENT DOCUMENTS

| | | | | |
|---|---|---|---|---|
| 2006/0059628 | A1* | 3/2006 | Hamilton et al. | 5/653 |
| 2008/0076636 | A1* | 3/2008 | Smith | 482/1 |
| 2011/0012405 | A1* | 1/2011 | Conforti | 297/223 |

OTHER PUBLICATIONS

"The 'Tough Guy' Foam Shield" by Rib Saver, www.awma.com webiste.

"Squeaky Rib Saver" www.awma.com website.

Various shields from www.amazon.com website (www.amazon.com/b?ie=UTF8&node=3415081.

"Deluxe Kicking Shield" from TigerStrike.com website, www.tigerstrike.com/kickingshield.html.

"Windy Shield" from CombatSports.com website, www.combatsports.com/Windy-Shield/productinfo/SHIELD+4/.

"Big Pad Shield" by Combat Sports, from www.karatedepot.com/tr-sh-100.html.

"20" x 18" Leg Kick Pad" by Throwdown, from www.karatedepot.com/tr-sh-213.html.

* cited by examiner

MARTIAL ART TRAINING PAD

CROSS-REFERENCE TO RELATED APPLICATIONS

This application claims the benefit of U.S. Provisional Patent Application 61/269,248, filed on Jun. 22, 2009, and incorporated herein by reference.

STATEMENT REGARDING FEDERALLY SPONSORED RESEARCH AND DEVELOPMENT

Not Applicable.

FIELD OF THE INVENTION

This invention relates to martial arts training, and more particularly to a martial arts training pad.

DISCUSSION OF RELATED ART

Martial arts and fight training involve, in part, learning techniques for striking and kicking using various parts of the body. These include hand strikes (e.g., punches, palm strikes, hammer fists, backfists, chops, open handed slaps, etc.), elbow and forearm strikes, knee strikes and kicks (e.g., front kicks, sidekicks, roundhouse kicks, back kicks, groin kicks, etc.). It is generally accepted that practicing strikes and kicks by hitting a target or pad, rather than simply going through the motion in the air, is a beneficial training method because doing so improves accuracy, develops timing, strength and power, and provides more realistic exposure through contact and resistance.

Some training pads are placed on the trainer's hands such as focus mitts which are a pair of pads worn like gloves, such as those made by Everlast of Kansas City, Mo. Such focus mitts are designed to train hand strikes and are commonly used in boxing. Another type of training pad, the so-called Muay That pads, are also used in pairs and are grasped by the hands and braced against the forearms of the trainer. They are used to train hand strikes, knee strikes and some kicks (such as roundhouse kicks). Certain strikes and kicks (e.g., groin kicks, upward/downward hammer fists, upward/downward elbow strikes, etc.), because of the direction in which they are delivered and the nature of their intended targets, are more effectively trained using a pad that is structurally stiff and is held away from the trainer's body in a generally horizontal orientation. Another type of pad, sometimes referred to as a "tombstone pad," works well for this purpose. A tombstone pad is made of dense, relatively stiff padding and it typically has a cross-sectional shape of an isosceles trapezoid. This pad's stiffness, structural rigidity and density compared to its relatively short length allows it to be held at its ends and to receive kicks or strikes near its center region without folding in on itself or deflecting excessively. Because focus mitts, Muay That pads and tombstone pads are smaller in size and braced by the trainer's hands/arms, they are not suited for a variety of full power kicks which generate significant force or that are linear or thrusting in nature.

When heavy kicking is to be trained, larger pads offering more protection for the trainer are used. Two such pads are the "suitcase pad," and a pad commonly called a "shield," typical versions of both available from Combat Sports International of Lenexa, Kans. A suitcase pad gets its name because it generally resembles the size and look of a midsized suitcase. It typically is filled with higher density foam and has handles protruding from the shorter sides of the pad on opposing ends.

One of the primary uses of the suitcase pad is for training low kicks aimed at the thigh or knee region. The pad is held by one of the handles and hung low against the user's leg. The suitcase pad can also be held against the user's torso and used to train various strikes and kicks. Because a typical suitcase pad uses high density foam, it is relatively effective at providing protection against penetration force, but not very effective at protecting against shock force. Being the recipient of repeated, full force shock blows can be very uncomfortable, debilitating and unhealthy.

A martial arts shield is a larger and thicker pad that is braced against the trainer's body. A typical shield is generally rectangular in shape and is designed to be used in the vertical orientation thereby covering a good portion of the trainer's torso. It is comprised of a cover (typically vinyl, canvas or leather) and an interior core of padding. The purpose of the padding is to absorb the force of strikes and kicks and to protect the trainer from pain and injury. The padding used in typical shields varies. Some shields use a lower density, spongier foam for the padding. Such foam is good at absorbing the shock force generated by slapping type strikes and kicks thereby preventing the shock from transferring to the trainer where it would rattle his bones and head. This type of foam is also gentler on and more comfortable for the person delivering the strikes and kicks. However, lower density, spongy foam is not effective for stopping the penetrating force of linear or thrusting strikes and kicks. Thus, for example, the trainer would feel the penetration of repeated, full force knee strikes delivered to his gut thereby suffering pain and possible injury. Alternatively, some shields use higher density foam which is better suited to stopping the penetrating force of linear or thrusting strikes and kicks. However, this type of foam is not as good at absorbing the shock force of slapping type strikes and kicks. Available shields, of either variety, are not stiff enough to prevent being severely bent or folded in upon themselves when held at their ends and kicked or struck at their centers with significant force.

A typical shield has two or three handles. Two of the handles are vertically oriented and are placed on the back face of the shield near one of its ends. They are intended to allow the trainer to slip his forearm through the first of such handles and grasp the second with the same hand. A third handle is sometimes placed on the back face near the other end of the shield and it is horizontally oriented. Such a third handle is grasped by the trainer's other hand. In this manner, one of the trainer's forearms is braced between his torso and the shield. This is done in an attempt to help protect the user. In reality, however, this is ineffective and may even result in pain and injury. If the trainer holds the shield tight against his body so as to provide a solid and stable target for the person striking and kicking, the trainer's forearm will absorb a good deal of force before it reaches his torso and ribs and if the strike or kick is delivered with power, the trainer can injure his wrist, forearm, elbow and/or shoulder. Also, the trainer's forearm or hand can be driven into his gut, solar plexus or ribs causing pain, knocking the wind out of him, or even resulting in injury. Therefore, in order to avoid pain and injury, the strikes and kicks will have to be delivered at less than full power (which limits the effectiveness of training) or the trainer will protect himself by pushing the pad out and away from his body to meet the strike or kick before impact. While this strategy serves to protect the trainer, doing so comes at the expense of the person striking and kicking for a number of reasons. First, if the timing is off, the trainer can unnaturally and prematurely jam the strike or kick before it is delivered. Second, because the trainer is moving the pad around, the target is not firm, solid or stable. For linear or thrusting strikes and kicks, the result is that instead of contacting a firm surface, the strikes and kicks tend to glance off the pad negating resistance and a realistic feeling of contact. Third, the trainer may even injure the person striking or kicking in order to protect himself by turning the pad causing the strikes and kicks to glance off it rather than meet it forcefully. This can lead to hyperextension of joints in the kicking or striking limb, and also (in the case of kicks) twisted or dislocated ankles or knee joints in the base leg.

Other types of pads are disclosed in U.S. Pat. No. D489,846 to Singh on May 11, 2004; U.S. Pat. No. 5,501,649 to Queppet on Mar. 26, 1996; U.S. Pat. No. 4,667,954 to McCorkle on May 26, 1987; and U.S. Pat. No. 2,526,217 to gilman on Oct. 17, 1950. Such devices suffer many of the same drawbacks of the aforementioned pads.

Thus, it would be beneficial for martial arts and fight training to have a versatile pad that could be used to effectively protect the trainer against a variety of full powered strikes and kicks while offering the person striking and kicking a comfortable yet solid and stable target against which to practice. It would be ideal for such a pad to protect against penetrating force, shock force and deflecting force such that the pad could be used for a wide array of training needs with minimal pain, harm or injury to the trainer. The versatility of such a pad would be increased if the pad could be used in a horizontal orientation as well as a vertical orientation and if both the front and rear faces of the pad could be presented to the trainee as target surfaces having different firmnesses to accommodate trainees of different sizes, strengths, experience and skill. It would be beneficial if the pad could adequately protect the trainer while he held it directly and firmly against his body (e.g., torso region for mid or high range strikes and kicks) without the need to insert his forearm between the pad and his body, and further if the pad could be securely held away from the trainer's body in a horizontal orientation to provide a solid target and adequate protection against certain strikes and kicks that are delivered in upward or downward angles. It would also be beneficial if the pad could effectively be hung and held flush against the trainer's leg in order to safely enable practice of powerful low kicks directed at the thigh or knee region. In addition to its versatility of use, such a needed device would also be relatively inexpensive to manufacture and easy to clean. The present invention accomplishes these objectives.

SUMMARY OF THE INVENTION

The present device is a pad system for use in training for martial arts, combat, self-defense, fight training, or the like. The pad system includes a long chamber having a first flexible sheath that surrounds a first cushioning pad. The first cushioning pad is preferably relatively rigid so as to prevent penetration and deflection thereof and is also resilient in order to provide an outer layer of shock protection for the trainer and a comfortable contact surface for the trainee. A short chamber includes a second flexible sheath that surrounds a second cushioning pad of a second firmness. The second cushioning pad is preferably resilient, and spongy in nature so that it provides an inner layer of shock protection to prevent the shock force of a kick or punch from a trainee from damaging the user of the pad, such as a trainer, when the short chamber of the pad system is held directly against the trainer's body.

The short chamber is fixed at a front face thereof with a rear face of the long chamber, preferably such that opposing side edges of each chamber are substantially mutually aligned and such that top and bottom edges of the long chamber overhang top and bottom edges of the short chamber, respectively, thereby defining an overlapping volume adjacent the top and bottom edges of the short chamber.

The front and rear surfaces of each chamber are preferably substantially rectangular, and further the front and rear surfaces of the short chamber are preferably generally square. Further, each sheath of each chamber may include at least one air vent traversing therethrough, such that air is allowed to escape each chamber when compressed. Each sheath may also include a selectively closable opening for removal and insertion of the cushioning pads.

A pair of handles is included, each situated in one of the overlapping volumes and fixed to either of the chambers. A second pair of handles may also be fixed to the side edges of the short chamber, if desired, to increase the number of ways the pad system may be held by a user for protecting against various types of training blows.

In one embodiment, the long chamber and short chamber are mutually attached with a hook-and-loop type fastener, such that the two chambers may be separated and used individually as desired.

In a preferred embodiment of the invention, the first cushioning pad includes a plurality of layers of foam material, such as at least one layer of a first type of foam, fixed with at least one layer of a second type of foam. In one embodiment, the first type of foam has a firmness less than second type of foam but a firmness greater than that of the second cushioning pad.

The present invention is a versatile martial arts training pad system that may be used to effectively protect the trainer against a variety of full powered strikes and kicks while offering the person striking and kicking a comfortable yet solid and stable target against which to practice. The present system protects against penetrating force, shock force and deflecting force such that the device can be used for a wide array of training needs with minimal pain, harm or injury to the trainer. The versatility of such a pad is increased since the pad can be used in a horizontal orientation as well as a vertical orientation and because both the front and rear faces of the pad can be presented to the trainee as target surfaces having different firmnesses to accommodate trainees of different sizes, strengths, experience and skill. Further, the present invention protects the trainer while held directly and firmly against his body without the need to insert his forearm between the pad and his body. Further, the device can be securely held away from the trainer's body in a generally horizontal orientation to provide a relatively stiff target that won't bend excessively or fold in on itself from the impact of certain strikes and kicks that are delivered in upward or downward angles. The present device can be effectively hung and held flush against the trainer's leg in order to safely enable practice of powerful low kicks directed at the thigh or knee region. In addition to its versatility of use, the present device is relatively inexpensive to manufacture and easy to clean. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
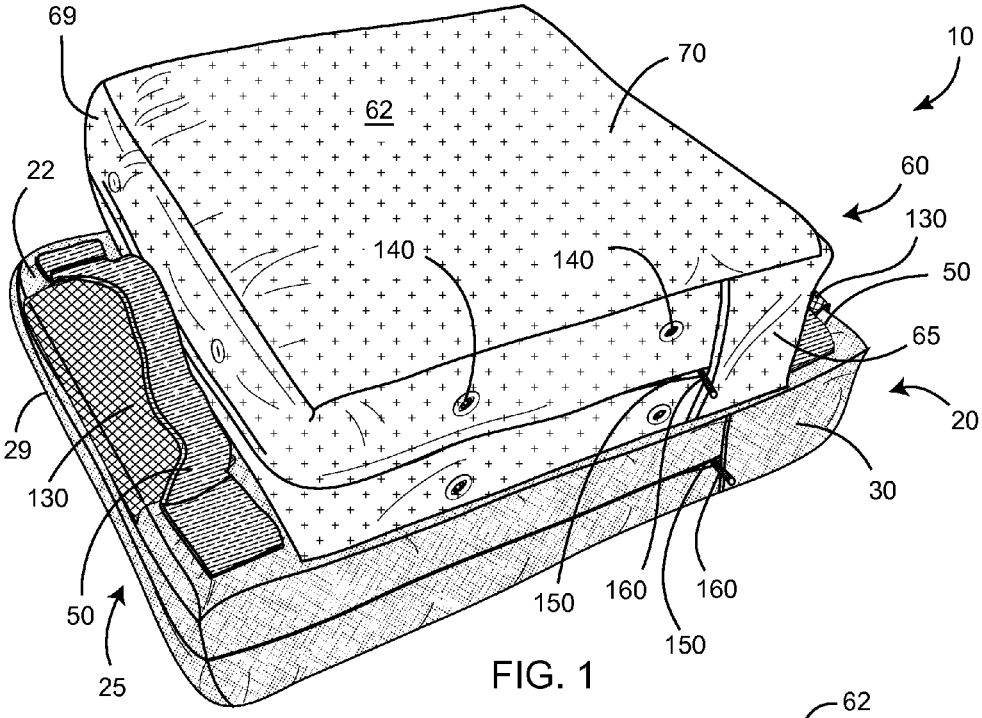
FIG. 1 is a perspective view of the invention, illustrating a short chamber and a long chamber of the invention.
Figure 3:
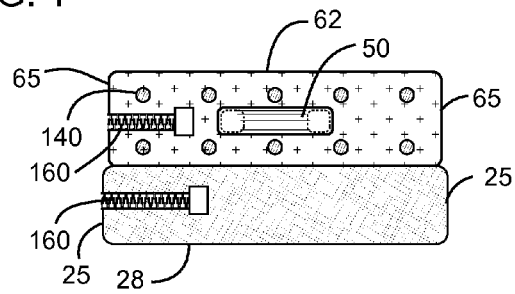
FIG. 3 is a top plan view thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

FIGS. 1-5 illustrate a pad system 10 for use in training for martial arts, combat, self-defense, fight training, or the like. The pad system 10 includes a long chamber 20 having a front face 28, a rear face 22, a top edge 29, a bottom edge 21, and two opposing side edges 25. A first flexible sheath 30 of the long chamber 20 surrounds a first cushioning pad 40 of a first firmness. The first cushioning pad 40 is preferably relatively rigid so as to prevent penetration and deflection thereof. However, the rigidity of the first cushioning pad 40 should not be so high that the first cushioning pad 40 is subject to cracking or breaking, that it fails to absorb shock effectively or that it provides a striking or kicking surface that is uncomfortable for the trainee. Thus, in one embodiment, the first cushioning pad 40 includes both a foam material having an indentation load deflection (ILD) of more than 75 with a density of greater than 2.0 pounds/cubic foot, such as polyurethane (ether) foam, for example, and also a semi-rigid closed-cell foam material, such as EVA foam or microcell foam having a density of between 5.0 and 7.0 pounds/cubic foot.

A short chamber 60 has a front face 68, a rear face 62, a top edge 69, a bottom edge 61, and two opposing side edges 65. A second flexible sheath 70 of the short chamber 60 surrounds a second cushioning pad 80 of a second firmness. The second cushioning pad 80 is preferably resilient, and spongy in nature so that it may absorb shock to prevent the shock force of a kick or punch from a trainee from damaging the user of the pad, such as a trainer. Thus, in one preferred embodiment, the second cushioning pad 80 comprises a resilient foam material having moderate to low firmness, such as a polyurethane (ether) foam having a density of 2.0 pounds/cubit foot or less and an ILD of less than 75, for example.

Figure 4:
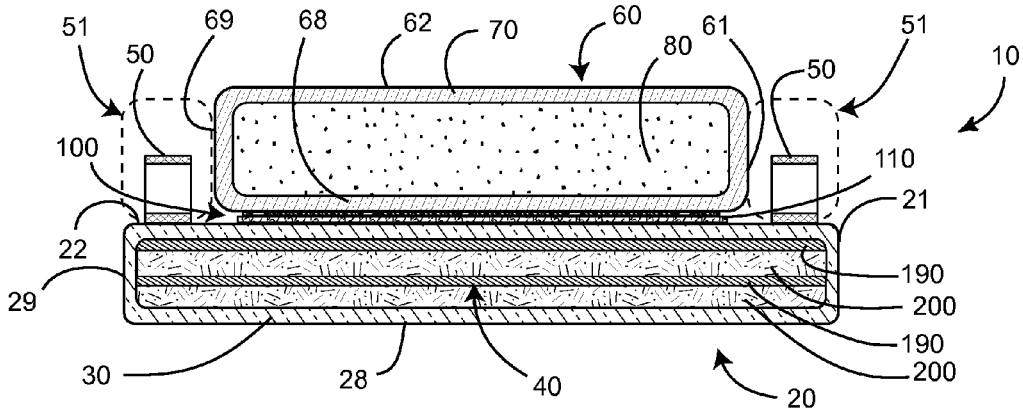
FIG. 4 is a cross-sectional side view thereof, illustrating one embodiment of the invention wherein a first cushioning pad is comprised of multiple layers of different types of foam materials.
Figure 5:
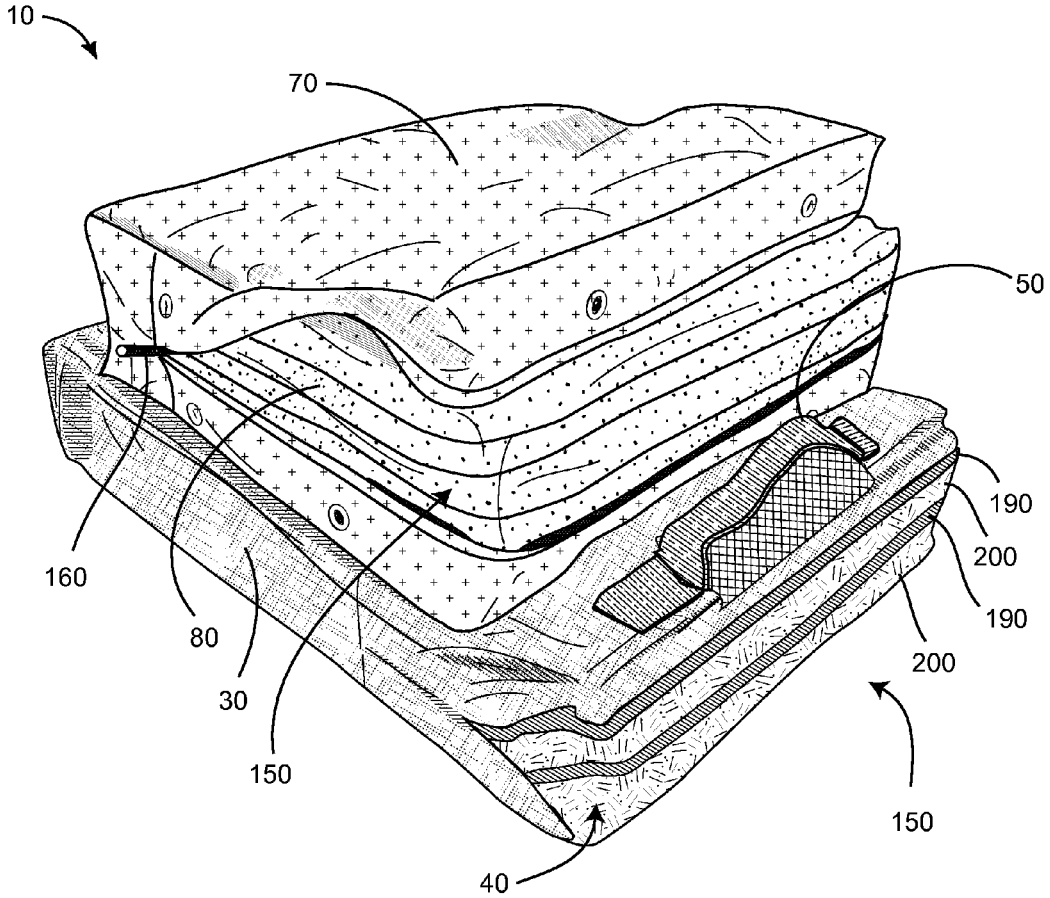
FIG. 5 is a perspective view of an alternate embodiment of the invention, illustrating the chambers each with an opening to expose cushioning pads therein.

The short chamber 60 is fixed at the front face 68 thereof with the rear face 22 of the long chamber 20, preferably such that the opposing side edges 25,65 of each chamber 20,60 are substantially mutually aligned and such that the top and bottom edges 29,21 of the long chamber 20 overhang the top and bottom edges 69,61 of the short chamber 60, respectively, thereby defining an overlapping volume 51 adjacent the top and bottom edges 69,61 of the short chamber 60 (FIG. 4). The chambers 20,60 may be mutually fixed with stitching, adhesive, ultrasonic welding, or the like.

The front and rear surfaces 28,68,22,62 of each chamber 20,60 are preferably substantially rectangular, and further the front and rear surfaces 28,62 of the short chamber 60 are preferably generally square. Further, each sheath 30,70 of each chamber 20,60 may include at least one air vent 140 traversing therethrough, such that air is allowed to escape each chamber 20,60 when compressed. Grommets are illustrated as the air vents in FIG. 1, but a section of fabric mesh (not shown) incorporated into either sheath 30,70 may also be used as an air vent 140. The air vents 140 are of sufficient size and number to allow the air within each chamber 20,60 to vent quickly enough when compressed by a sudden shock of a kick or punch, for example, that the cushioning pads 40,80 absorb the shock instead of compressed air within each chamber 20,60. Each sheath 30,70 may also include a selectively closable opening 150 for removal and insertion of the cushioning pads 40,80, such opening 150 being closable with a zipper 160 (FIGS. 1 and 3), the hook-and-loop type fastener 110, a cord strung through holes punched into the edges of the sheath panels (not shown), or the like.

Each flexible sheath 30,70 is made of a flexible, durable, tear resistant, and water resistant material such as vinyl, nylon, treated canvas, synthetic leather, genuine leather, or the like. The dimensions of the long chamber 20, in one embodiment, are 24 inches tall, 16 inches wide, and four inches thick. The dimensions of the short chamber 60, in one embodiment, are 16 inches tall, 16 inches wide, and five inches thick. Clearly, other chamber 20,60 sizes may be utilized as needed.

Figure 2:
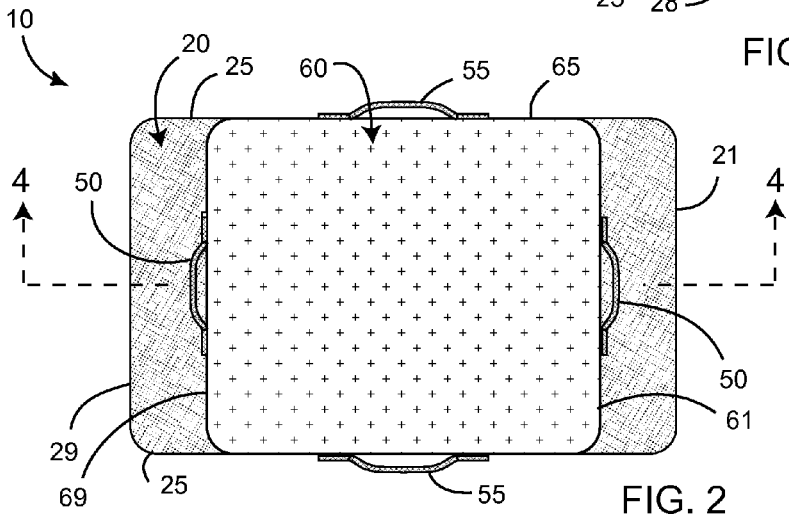
FIG. 2 is a rear elevational view thereof, illustrating an alternate embodiment have a first pair of handles and a second pair of handles.

A pair of handles 50 is included, each handle 50 situated in one of the overlapping volumes 51 and fixed to either of the chambers 20,60. In one embodiment, the handles are fixed to the rear face 22 of the long chamber 20 (FIG. 1). Alternately the handles 50 may be fixed to the top and bottom edges 69,61 of the short chamber (FIG. 2). A second pair of handles 55 may also be fixed to the side edges 65 of the short chamber 60, if desired, to increase the number of ways the pad system 10 may be held by a user for absorbing various types of martial art shocks. Such handles are preferably made from a nylon strap material and stitched to the first or second flexible sheath 30,70 as appropriate. In one embodiment, a high-friction gripping surface 130 (FIG. 1) may be fixed to the long chamber 20 proximate each of the handles 50 to provide a non-slip surface for the trainer's palms where it is most effective for him to slip his fingers under and through the handles 50 and rest his palms against the overhanging ends of the long chamber 20 such as when he is holding the pad system 10 in a generally horizontal orientation for certain kicks and strikes delivered in upward or downward angles.

In one embodiment, the long chamber 20 and short chamber 60 are mutually attached with a two-part fastener 100, such as a hook-and-loop type fastener 110 (FIG. 4). In this manner the two chambers 20,60 may be separated and used individually as desired. Moreover, the cushioning pads 40,80 may be removed from each so that the sheaths 30,70 may be washed, for example. Alternately, a portion of the first sheath 30 and the second sheath 70 may be integrally formed, such that the two chambers 20,60 are not mutually detachable.

In a preferred embodiment of the invention, the first cushioning pad 40 includes a plurality of layers of foam material, such as at least one layer 200 of a first type of foam that is resilient and capable of effectively absorbing shock, such as polyurethane (ether) foam, fixed with at least one layer 190 of a second type of foam that provides some stiffness to the pad to prevent it from bending excessively or folding in on itself, such as a semi-rigid closed-cell foam like EVA foam or microcell foam, for example. In one embodiment, the layer 200 of polyurethane (ether) foam has a firmness less than the layer 190 of semi-rigid closed-cell foam but a firmness greater than that of the second cushioning pad 80. For example, the second cushioning pad 80 may include a foam material having an ILD of less than 75, such as a polyurethane (ether) foam having a density of 2.0 pounds/cubit foot or less and an ILD of 45, while the first cushioning pad 40 may include two layers 200 of the first type of polyurethane (ether) foam, having an ILD of approximately 150, interspersed between two layers 190 of the second type of foam, such as EVA foam having a density of 6.0 pounds/cubic foot. As such, the second cushioning pad 80 absorbs shock to protect the user who holds the short chamber 60 against his body while holding onto the pad system 10 with the handles 50, while the long chamber 20 both absorbs shock but also prevents deflection and penetration of the first cushioning pad 40.

In use, a user or trainer holds the pad system 10 by either of the handles 50,55 typically with the short chamber 60 against his chest, while a trainee delivers physical kicks, punches, and the like to the long chamber 20. The overhang of the long chamber 20 helps protect the user's hands while gripping the handles 50. For young, small, or beginner trainees, the short chamber 60 can be turned outward and the pad system can be held by handles 55 in order to present to the trainee a softer, more comfortable target surface. Alternatively, the trainer can slip his fingers under and through the handles 50 resting his palms against the gripping surfaces 130 and holding the pad system 10 away from his body in a generally horizontal orientation to present a training target for certain strikes or kicks delivered in upward or downward angles. In such case, the long chamber 20 helps protect the trainer by preventing the pad system form bending excessively or folding in upon itself which if allowed to occur might result in the trainee's foot or hand contacting and hurting or injuring the trainer. Penetration of the long chamber 20 is prevented due to the firmer nature of the first cushioning pad 40 and tear resistance of the first flexible sheath 30, and shock is absorbed by both the first and second cushioning pads 40,80 to attenuate the shock forces experienced by the trainer.

While a particular form of the invention has been illustrated and described, it will be apparent that various modifications can be made without departing from the spirit and scope of the invention. For example, the shapes of the chambers 20,60 as illustrated in the figures is substantially rectangular, although other suitable shapes could be used, such as, but not limited to, oval, circular, hexagonal, trapezoidal, or the like. Moreover, the handles 50,55 illustrated in the figures show handles made of nylon-type strap material, but other types of handles 50,55 may be included, such as those formed by plastic molding, rubber tubing, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A pad system, comprising;

a long chamber having a front face, a rear face, a top edge, a bottom edge, two opposing side edges, and including a first flexible sheath surrounding a first cushioning pad of a first firmness;

a short chamber having a front face, a rear face, a top edge, a bottom edge, two opposing side edges, and including a second flexible sheath surrounding a second cushioning pad of a second firmness, the short chamber fixed at the front face thereof with the rear face of the long chamber such that the opposing side edges of each chamber are substantially mutually aligned and such that the top and bottom edges of the long chamber overhang the top and bottom edges of the short chamber, respectively, to define an overlapping volume; and a pair of handles, each situated in one of the overlapping volumes and fixed to either of the chambers.

2. The pad system of claim 1 wherein each handle is fixed to the rear face of the long chamber.

3. The pad system of claim 1 wherein each handle is fixed to one of the top and bottom edges of the short chamber.

4. The pad system of claim 1 further including a second pair of handles each fixed to one of the side edges of the short chamber.

5. The pad system of claim 1 wherein the first firmness is greater than the second firmness.

6. The pad system of claim 1 wherein the second cushioning pad includes a resilient foam material having an indentation load deflection of 75 or less.

7. The pad system of claim 1 wherein the first cushioning pad includes a foam material having an indentation load deflection of more than 75.

8. The pad system of claim 1 wherein the first cushioning pad includes a semi-rigid closed cell foam material.

9. The pad system of claim 1 wherein the first cushioning pad includes both a resilient foam material having an indentation load deflection of more than 75 and a semi-rigid closed foam material.

10. The pad system of claim 1 wherein the front and rear faces of each chamber are substantially rectangular.

11. The pad system of claim 10 wherein the front and rear faces of the short chamber are substantially square.

12. The pad system of claim 1 further including a two-part fastener fixed between the long and short chambers, whereby the long and short chambers are selectively detachable.

13. The pad system of claim 12 wherein the two-part fastener is a two-part hook-and-loop type fastener.

14. The pad system of claim 1 wherein at least a portion of the first and second flexible sheaths are integrally formed.

15. The pad system of claim 1 wherein the handles of each chamber are formed from a nylon strap material.

16. The pad system of claim 1 further including a high-friction gripping surface fixed to the rear face of the long chamber proximate the handles.

17. The pad system of claim 1 wherein the first flexible sheath of the long chamber includes at least one air vent traversing therethrough, whereby air is allowed to escape therethrough when the long chamber is compressed.

18. The pad system of claim 1 wherein the second flexible sheath of the short chamber includes at least one air vent traversing therethrough, whereby air is allowed to escape therethrough when the short chamber is compressed.

19. The pad system of claim 1 wherein each of the first and second sheaths each includes a selectively closable opening for removal and insertion of the first and second cushioning pads, respectively.

20. The pad system of claim 19 wherein the opening of each of the first and second sheaths is selectively closable with a zipper.

21. The pad system of claim 1 wherein the first cushioning pad comprises at least a first type of resilient foam material and a second type of semi-rigid closed-cell foam material, the first type of foam material having a firmness less than the second type of foam material but greater than the second firmness of the second cushioning pad, and wherein the second cushioning pad includes a resilient foam material.

* * * * *